United States Patent [19]

Sacchetti

[11] 4,430,635

[45] Feb. 7, 1984

[54] VARIABLE RESISTANCE DEVICE

[75] Inventor: Peter J. Sacchetti, Manchester, N.H.

[73] Assignee: New England Instrument Company, Natick, Mass.

[21] Appl. No.: 293,450

[22] Filed: Aug. 17, 1981

[51] Int. Cl.[3] ..... H01C 10/38

[52] U.S. Cl. ..... 338/176; 29/610 R; 200/269; 338/171; 338/202

[58] Field of Search ..... 338/176, 171, 167, 180, 338/202; 29/610 R; 200/269

[56] References Cited

U.S. PATENT DOCUMENTS

| | | | |
|---|---|---|---|
| 2,721,246 | 10/1955 | Bourns | 338/202 |
| 3,343,115 | 9/1967 | Greenwood | 338/202 X |
| 3,686,457 | 8/1972 | Dubac et al. | 200/166 C |
| 4,374,311 | 2/1983 | Okahashi et al. | 200/269 |

*Primary Examiner*—C. L. Albritton

*Attorney, Agent, or Firm*—John E. Toupal; Harold G. Jarcho

[57] ABSTRACT

A variable resistance device including a non-conducting base, a resistance supported by the base and forming a track surface, and an electrical terminal connected to the resistance. Also included in the device is a wiper assembly mounted for movement relative to the resistance and comprising a carrier, an elongated conductive spring member having one end secured to the carrier, a conductive coupling element bonded to an opposite end of the spring member and a corrosion resistant contact bonded to the coupling element and disposed to traverse the track surface during movement of the wiper assembly relative thereto.

11 Claims, 4 Drawing Figures

VARIABLE RESISTANCE DEVICE

BACKGROUND OF THE INVENTION

This invention relates generally to variable resistance devices and, more particularly, to such devices that employ a resistance element with a surface that is traversed by a wiper contact.

Wiper contacts are used in a variety of variable resistance devices such as potentiometers, rheostats, etc. To provide and retain the electrical performance required, the wiper contacts used with such devices must possess a number of characteristics including resiliency, low contact resistance with high electrical conductivity and resistance to wear and corrosion. Because of these stringent requirements, platinum or other precious metal alloys are generally used for variable resistance wiper contacts. The high cost of such materials contribute substantially to the total cost of the complete device.

In the interest of economy, there have been proposed composite wiper contacts consisting of a contact tip formed of a precious metal and an elongated spring portion formed of Beryllium copper or the like. A composite wiper contact of this type is disclosed, for example, in U.S. Pat. No. 2,721,246. Although they reduce the overall cost of variable resistance devices, composite wiper contacts have not been used extensively because of various disadvantages including expensive production requirements, unreliability, poor electrical performance, etc.

The object of this invention, therefore, is to provide an improved, variable resistance device of the type employing a wiper contact.

SUMMARY OF THE INVENTION

The invention is a variable resistance device including a non-conducting base, a resistance supported by the base and forming a track surface, and an electrical terminal connected to the resistance. Also included in the device is a wiper assembly mounted for movement relative to the resistance and comprising a carrier, an elongated conductive spring member having one end secured to the carrier, a conductive coupling element bonded to an opposite end of the spring member and a corrosion resistant contact bonded to the coupling element and disposed to traverse the track surface during movement of the wiper assembly relative thereto. The coupling element serves as a matching material to facilitate bonding of both the spring member and the contact thereby permitting the use in those components of specific materials that provide good performance at reduced cost.

In a preferred embodiment of the invention, the coupling element is an inlay cold rolled into a recess in the spring member and the contact is joined to the coupling element by a thermocompression bonding process. These processes permit highly efficient fabrication of the composite wiper assembly with materials having specifically desirable characteristics.

One feature of the invention is the use for the contact of a wire disposed transversely to the elongated spring member and bonded to the coupling element. The wire provides for the contact desirable operating characteristics of both an electrical and mechanical nature.

According to another feature of the invention, the portion of the wiper assembly formed by the bonded together spring member, coupling element and wire contact defines a plurality of slots extending longitudinally to the elongated spring member and forming a plurality of tines, each having a portion of the wire contact for engaging the resistance track surface during movement of the wiper assembly relative thereto. The multiple tines provide the wiper assembly with the operating characteristics desired for the wiping contact of a variable resistance device.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
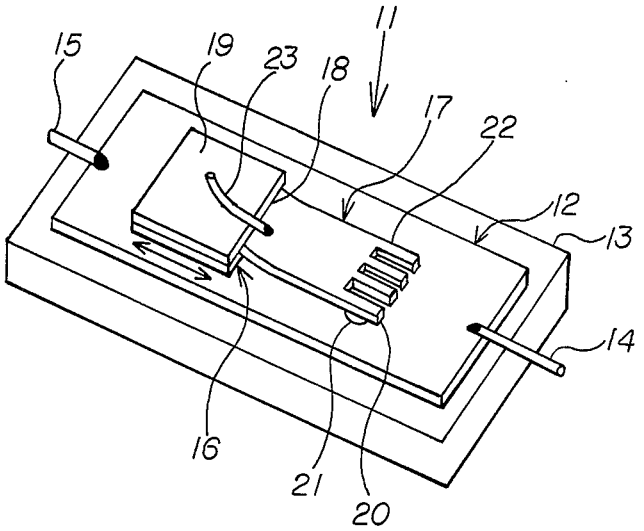
FIG. 1 is a schematic perspective view of a variable resistance device according to the invention.
Figure 2:
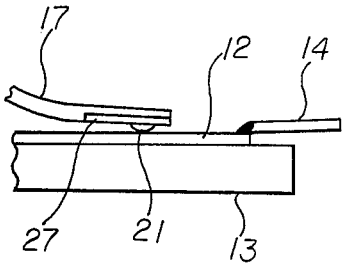
FIG. 2 is a schematic partial side view of the device shown in FIG. 1.

Illustrated schematically in FIG. 1 is a variable resistance device 11 constructed according to the invention. A strip of electrical resistance 12 is supported on an electrically non-conductive base 13. Connected to opposite ends of the resistance strip 12 are, respectively, electrical terminals 14 and 15. A wiper assembly 16 is positioned above the base 13 and is movable relative thereto by conventional drive means (not shown) in directions parallel to the strip 12. Included in the wiper assembly 16 is an elongated spring member 17 having one end 18 attached to a carrier block 19. Contacts 21 attached to the opposite end 20 of the spring member 17 are disposed to ride along the upper track surface 22 of the resistance strip 12 during movement of the wiper assembly 16 as shown most clearly in FIG. 2. Connected to the one end 18 of the spring member 17 is an electrical terminal 23. The device 11 functions in a conventional manner to provide variable resistance values between the terminals 14, 15 and 23 as determined by the relative position of the contacts 21 on the track surface 22 of the resistance strip 12.

Figure 3:
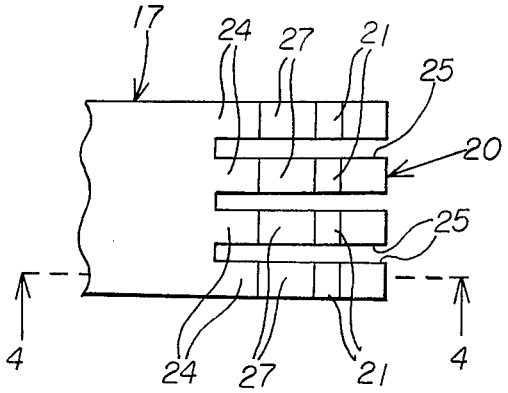
FIG. 3 is a schematic partial bottom view of the contact portion of the wiper assembly shown in FIG. 1.
Figure 4:
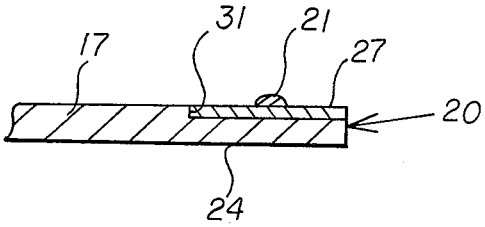
FIG. 4 is a schematic cross-sectional view taken along lines 4—4 of FIG. 3.

Referring now to FIGS. 3 and 4, there are shown further details of the opposite end 20 of the spring member 17. A plurality of tines 24 extending longitudinally of the elongated spring member 17 are formed by a plurality of slots 25 therein. As shown in FIG. 4, each tine 24 includes a coupling element strip 27 inlaid in a surface recess 31 at the opposite end 20 of the elongated spring member 17. Also included on each tine 24 is a portion of the contact 21 in the form of a wire bonded to the outer surface of the coupling element 27.

According to a preferred method of producing the wiper assembly 16, the spring member 17 is prepared from flat stock of material having suitable spring and electrical conductivity characteristics. After skiving the recess 31 out of the end 20, the coupling element 27 is inserted and bonded to the member 17 with a cold rolling process. Next, the member 17 is passed through a "scrubber" to remove oxidation from the exposed surface of the coupling element 27. A wire 21 is then positioned transverse to the elongated member 17 on the surface of the coupling element 27 and is securely bonded thereto by a thermocompression process. A preferred method and apparatus for creating the bond between the contact wire 21 and the coupling element 27 is disclosed in U.S. Pat. No. 3,834,604. After completing the bonding of the spring member 17, the coupling element 27 and the contact wire 21, the slots 25 are cut into the end 20 to form the tines 24. Preferably, the above operations are performed on a continuous strip of spring stock from which individual units are stamped. The completed units can then be attached to carriers 19 and assembled into completed devices 11.

The materials used in the formation of the composite wiper assembly 16 are extremely important to the ultimate performance of the device 11. For example, in addition to being electrically conductive, the spring member 17 should be sufficiently resilient to maintain substantial contact pressure between the contacts 21 and the track surface 21 during movement of the wiper assembly 16. In addition, the initial resiliency of the spring member 17 should be retained during the relatively high temperature bonding of the contact 21 to the coupling element 21. For these reasons, the material used for the spring member 17 should have a minimum modulus of elasticity of $28\times10^6$ psi and a minimum annealing temperature of 1850° F. To facilitate spot welding techniques during fabrication of the wiper assembly 16, it is highly desirable also that the spring member 17 also possess a resistivity of 40–100 microohm centimeters. In addition to providing a desirable high contact force with its rounded geometry, the contact wire should be highly corrosion and wear resistant and both mechanically and electrically compatible with the resistance strip 12. Preferably, the contact wire 21 should consist of a noble metal alloy having a minimum Knoop hardness of 300.

During development of the device 11, it was discovered that materials having the performance characteristics required for both the spring member 17 and the contacts 21 were not compatible for use in a thermocompression process that greatly simplifies fabrication of the wiper assembly 16. This problem is overcome in the present invention by the coupling element 27 that establishes a good bond first with the spring member 17 and thereafter with the wire contact 21 during the thermocompression process. To satisfy these functions, the coupling element 27 consists of an electrically conductive material that is substantially softer than the relatively hard contact wire 21.

A specific embodiment of the device 11 satisfying the above performance characteristics consists of a spring member 17 formed of stainless steel (S30200), a contact wire 21 formed of a palladium, silver, platinum alloy (ASTM B563 or B540), a coupling element 27 formed of copper, and a resistance element 12 formed of a conductive plastic of the type disclosed in U.S. Pat. No. 3,457,537.

Obviously, many modifications and variations of the present invention are possible in light of the above teachings. For example only, the units 17 can be used with other types of sliding contact devices such as slip rings or commutators. It is to be understood, therefore, that the invention can be practiced otherwise than as specifically described.

What is claimed is:

1. An electrical device comprising:

a non-conductive base;

an electrically conductive means supported by said base and forming a track surface;

electrical terminal means connected to said electrically conductive means; and a wiper assembly mounted for movement relative to said electrically conductive means and comprising a carrier means, an elongated conductive spring member having one end secured to said carrier means, a conductive coupling element bonded to an end of said spring member opposite to said one end, and a corrosion resistant contact means thermocompression bonded to said coupling element and disposed to ride along said track surface during said movement of said wiper assembly relative thereto and wherein said coupling element is formed from a material different than the materials forming either said spring member or said contact means, said spring member being formed from a material having a minimum modulus of elasticity of $28\times10^6$ psi and a resistivity between 40–100 microohm centimeters, said contact means being formed from a noble metal alloy having a minimum Knoop hardness of 300, and said coupling element being formed from a material substantially less hard than said material forming said contact means.

2. A device according to claim 1 wherein said bonded opposite end of said spring member, said coupling element, and said contact means are furcated to form a plurality of tines each having a portion of said contact means disposed to ride along said track surface during said movement of said wiper assembly relative thereto.

3. A device according to claim 1 wherein said electrically conductive means comprises a resistance means.

4. A device according to claim 3 wherein said spring member is formed from stainless steel, said coupling element is formed from copper, and said contact means is formed from a palladium-silver-platinum alloy.

5. A device according to claim 1 wherein said contact means comprises a wire means bonded to said coupling element and disposed transversely to said elongated spring member.

6. A device according to claim 5 wherein the portion of said wiper assembly formed by said bonded opposite end of said spring member, said coupling element, and said wire contact means defines a plurality of slots extending longitudinally of said elongated spring member and forming a plurality of tines each having a portion of said wire contact means disposed to ride along said track surface during said movement of said wiper assembly relative thereto.

7. A device according to claim 6 wherein said coupling element and said spring member are joined by a cold rolling process.

8. A method of forming a wiper assembly for a variable resistance device comprising the steps of:

forming an elongated member from a sheet of an electrically conductive spring material;

inlaying an electrically conductive coupling element into an end of said elongated member;

processing said coupling element to remove oxidation therefrom;

thermocompressing a corrosion resistant electrical contact to said coupling element; and cutting slots through said combined elongated member, coupling element, and contact so as to form therewith a plurality of tines each extending longitudinally of said elongated member and including a portion of said contact.

9. A method according to claim 8 wherein said electrical contact is a wire disposed transversely to said elongated member.

10. A method according to claim 9 wherein said inlaying step comprises skiving a recess into said end of said elongated member, forming said coupling element into the shape of said recess, and bonding said formed coupling element into said recess with a cold rolling process.

11. A method according to claim 8 wherein said spring member is formed from a material having a minimum modulus of elasticity of $28 \times 10^6$ psi and a resistivity between 40–100 microohm centimeters, said contact means is formed from a noble metal alloy having a minimum Knoop hardness of 300, and said coupling element is formed from a material substantially less hard than said material forming said contact means.

* * * * *